US008161983B1

(12) United States Patent
Lee

(10) Patent No.: US 8,161,983 B1
(45) Date of Patent: Apr. 24, 2012

(54) CUTICLE OIL DISPENSING PEN WITH CERAMIC STONE

(75) Inventor: Young Hoon Lee, New York, NY (US)

(73) Assignee: Young Hoon Lee, Whitestone, NY (US)

( * ) Notice: Subject to any disclaimer, the term of this patent is extended or adjusted under 35 U.S.C. 154(b) by 81 days.

(21) Appl. No.: 12/760,402

(22) Filed: Apr. 14, 2010

(51) Int. Cl.
*A61C 15/00* (2006.01)

(52) U.S. Cl. ..... 132/324

(58) Field of Classification Search ..... 132/74.5, 132/73, 73.5, 75.3, 75.6, 76.4
See application file for complete search history.

(56) References Cited

U.S. PATENT DOCUMENTS 2,724,850 A * 11/1955 Howard et al. ..... 401/17
4,343,910 A * 8/1982 Busch et al. ..... 521/82

* cited by examiner

*Primary Examiner* — Rachel Steitz
(74) *Attorney, Agent, or Firm* — Pro-Vision International

(57) ABSTRACT

A cuticle oil dispenser pen that simplifies the process of cuticle treatment by dispensing moisturizing cuticle oil while cutting and smoothing the cuticle with the associated porous ceramic cuticle stone.

10 Claims, 8 Drawing Sheets

CUTICLE OIL DISPENSING PEN WITH CERAMIC STONE

BACKGROUND OF THE INVENTION

1. Field of the Invention

The present invention relates generally to cuticle care and, more specifically, to a cuticle oil dispensing pen with a ceramic cuticle stone. Cuticle care usually involves a two step process involving moisturizing the cuticle and then cutting and smoothing it. The present invention simplifies this procedure by providing a dispensing pen having a reservoir containing cuticle oil that is delivered by seepage through the stone thereby moisturizing the cuticle simultaneously as the ceramic stone cuts and smoothes it. The present invention provides a fast, efficient means for cuticle care overcoming the shortcomings of the prior art.

2. Description of the Prior Art

There are other heated devices designed as applicators. While these applicators may be suitable for the purposes for which they were designed, they would not be as suitable for the purposes of the present invention, as hereinafter described.

SUMMARY OF THE PRESENT INVENTION

A primary object of the present invention is to provide a cuticle oil dispenser pen.

Another object of the present invention is to provide a cuticle oil dispenser pen having a body with a reservoir for storing cuticle oil.

Yet another object of the present invention is to provide a cuticle oil dispenser pen having a porous ceramic cuticle stone projecting from one end of the dispenser pen's body.

Still yet another object of the present invention is to provide a cuticle oil dispenser pen with a channel communicating between the reservoir and the porous ceramic stone.

Another object of the present invention is to provide a cuticle oil dispenser pen that will deliver oil to moisturize the cuticle simultaneously with treatment from the porous ceramic cuticle stone.

Still another object of the present invention is to provide a cuticle oil dispenser pen with a refillable reservoir.

Additional objects of the present invention will appear as the description proceeds.

The present invention overcomes the shortcomings of the prior art by providing a cuticle oil dispenser pen that simplifies the process of cuticle treatment by dispensing moisturizing cuticle oil through the porous ceramic stone while cutting and smoothing the cuticle.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
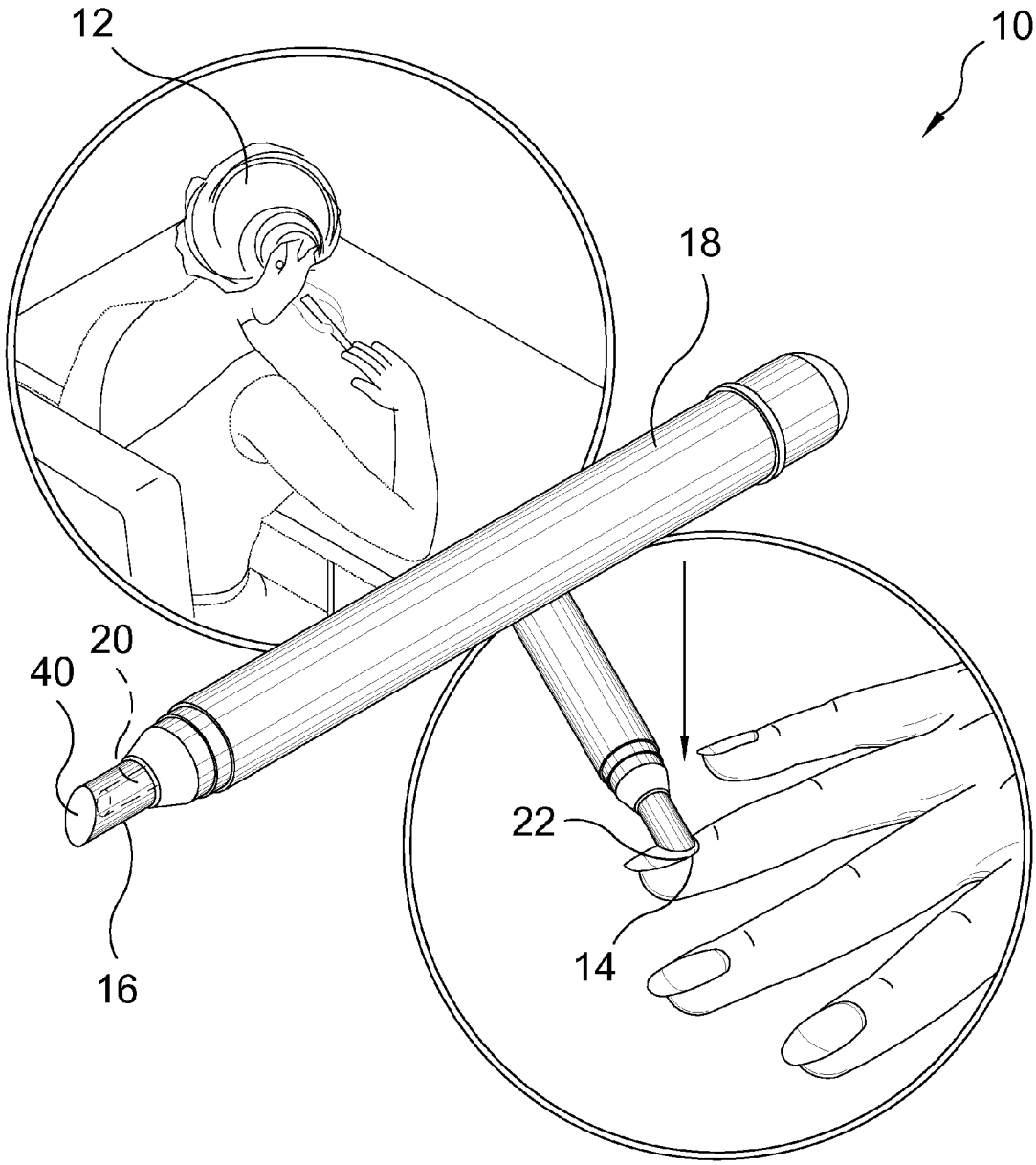
FIG. 1 is an illustrative view of the present invention in use.

Turning now descriptively to the drawings, in which similar reference characters denote similar elements throughout the several views, the figures illustrate the Combination Cuticle Oil Dispenser and Ceramic Cuticle Stone of the present invention. With regard to the reference numerals used, the following numbering is used throughout the various drawing figures.

10 Combination Cuticle Oil Dispenser and Ceramic Cuticle Stone of the present invention
12 user
14 cuticle of 12
16 porous ceramic cuticle stone
18 body of 10
20 cavity of 16
22 cuticle oil
24 cap
26 oil conduit
28 reservoir
30 gasket
32 filter
34 refill plug
36 first end of 18
38 second end of 18
40 angular distal surface of 16

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention in use. Shown is the user 12 treating her cuticles with the cuticle oil dispenser pen 10 of the present invention. Moisturizing cuticle oil 22 is delivered through a channel 20 into the porous ceramic cuticle stone 16 to the cuticle 14. A reservoir is contained within the body 18 of the pen to store the oil therein.

Figure 2:
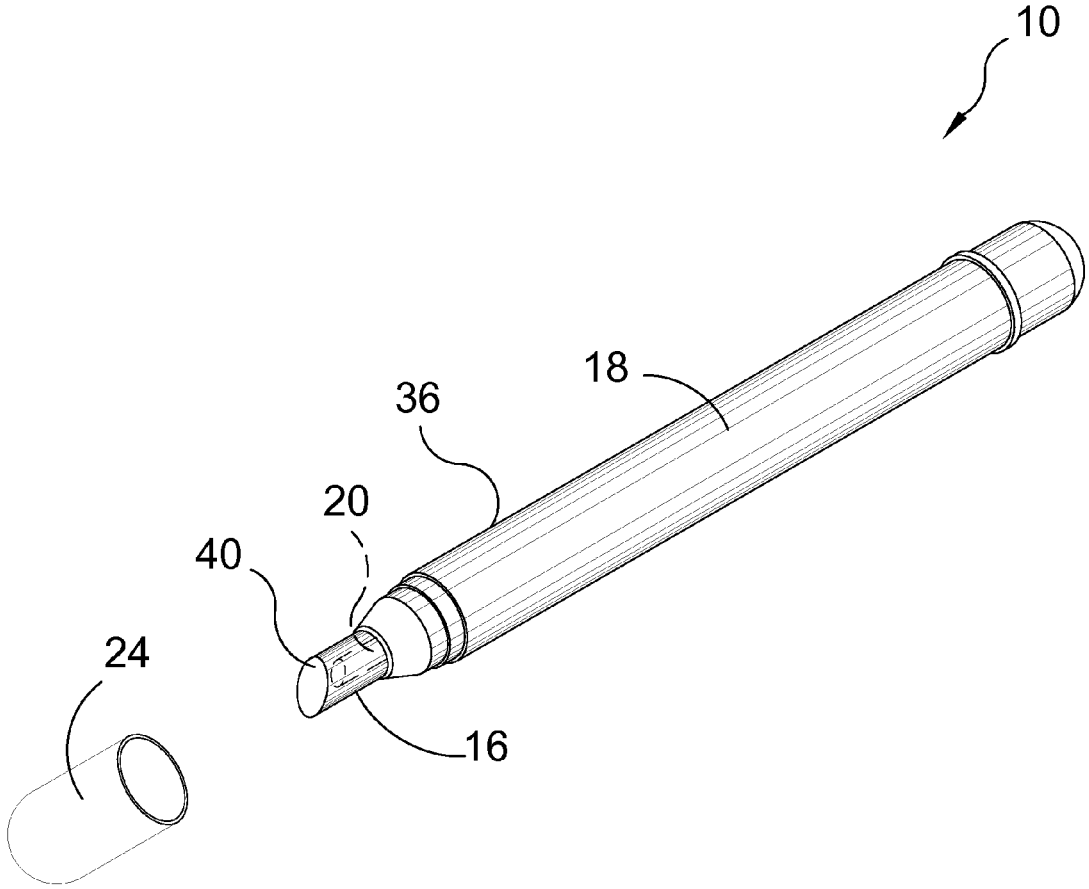
FIG. 2 is an illustrative view of the present invention.

FIG. 2 is an illustrative view of the present invention. Shown is the cuticle oil dispenser pen 10 having a cap 24 that snaps onto the first end 36 of the body 18 to protect the porous ceramic cuticle stone 16 which has an angular distal surface 40.

Figure 3:
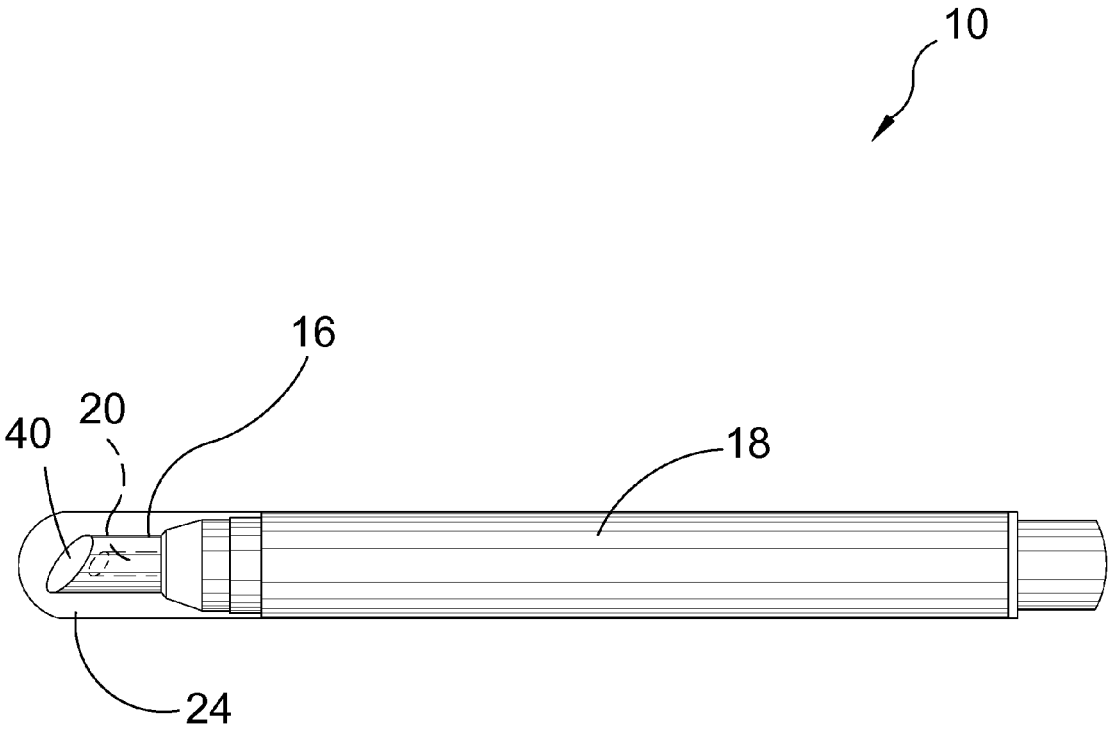
FIG. 3 is a side view of the present invention.

FIG. 3 is a side view of the cuticle oil dispenser pen 10 of the present invention. Shown is the cap 24 snapped onto the body 18 to protect the porous ceramic cuticle stone 16.

Figure 4:
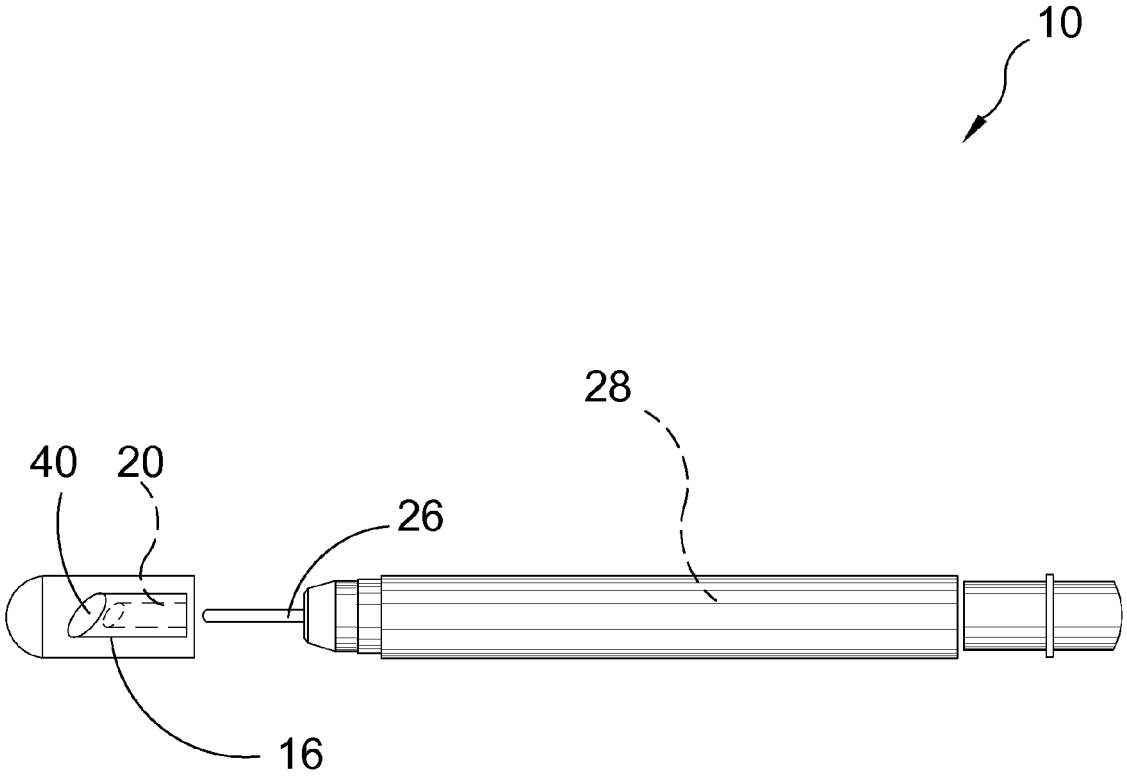
FIG. 4 is a side view of the present invention.

FIG. 4 is a side view of the cuticle oil dispenser pen 10 of the present invention. Shown is the oil conduit 26 that transfers the cuticle oil from the reservoir 28 through the channel 20 into the porous ceramic cuticle stone 16.

Figure 5:
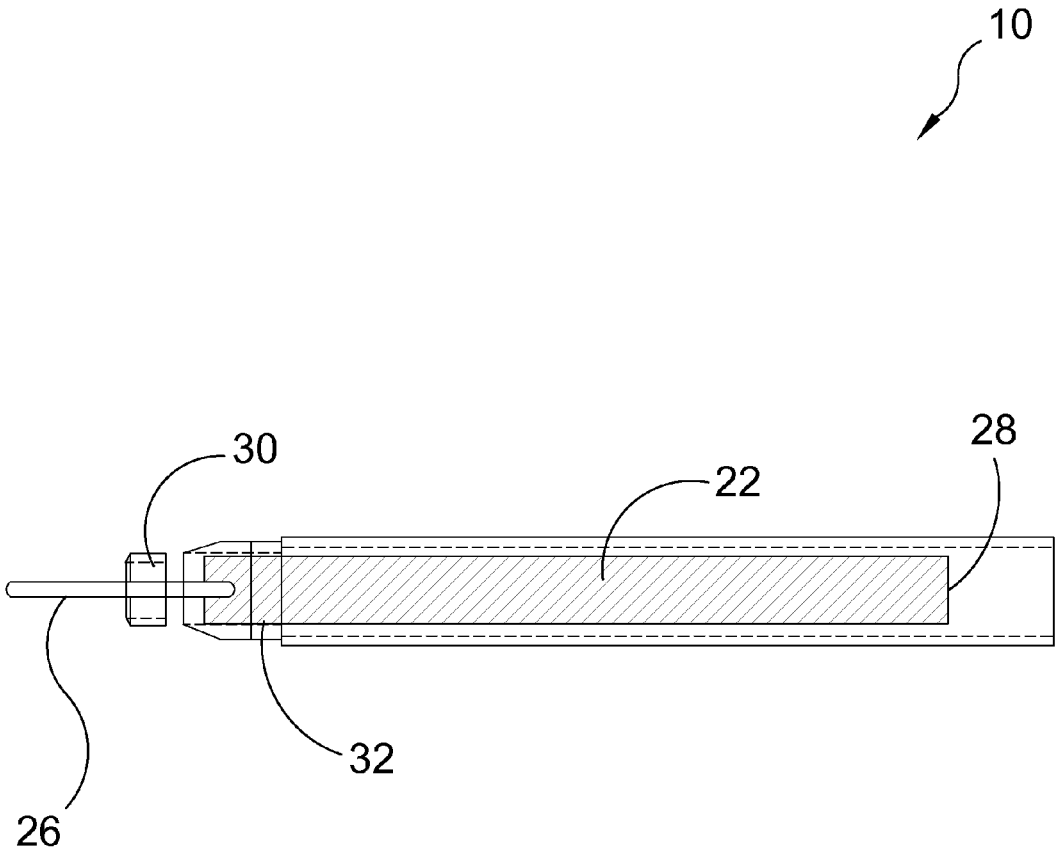
FIG. 5 is a side sectional view of the present invention.

FIG. 5 is a side sectional view of the cuticle oil dispenser pen 10 of the present invention. Shown is the assembly of delivery means of the cuticle oil 22 from the reservoir 28 through a filter 32 and into the conduit 26. A gasket 30 is provided to prevent leakage from the reservoir 28.

Figure 6:
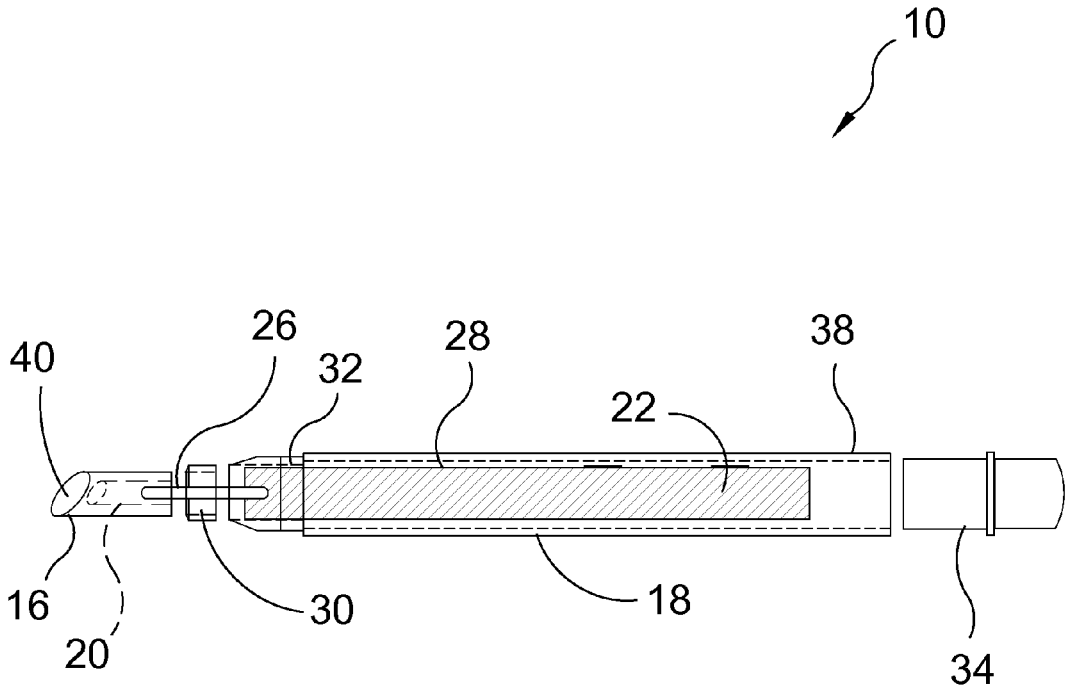
FIG. 6 is an exploded side sectional view of the present invention.

FIG. 6 is an exploded side sectional view of the cuticle oil dispenser pen 10 of the present invention. Shown is the assembly of delivery means of the cuticle oil 22 from the reservoir 28 in the body 18 through a filter 32 and into the conduit 26 which passes through the channel 20 into the porous stone 16. A gasket 30 is provided to prevent leakage from the reservoir 28 and a refill plug 34 disposed on the second end 38 of said body 18 to provide access to the reservoir 28 for refilling the oil 22.

Figure 7:
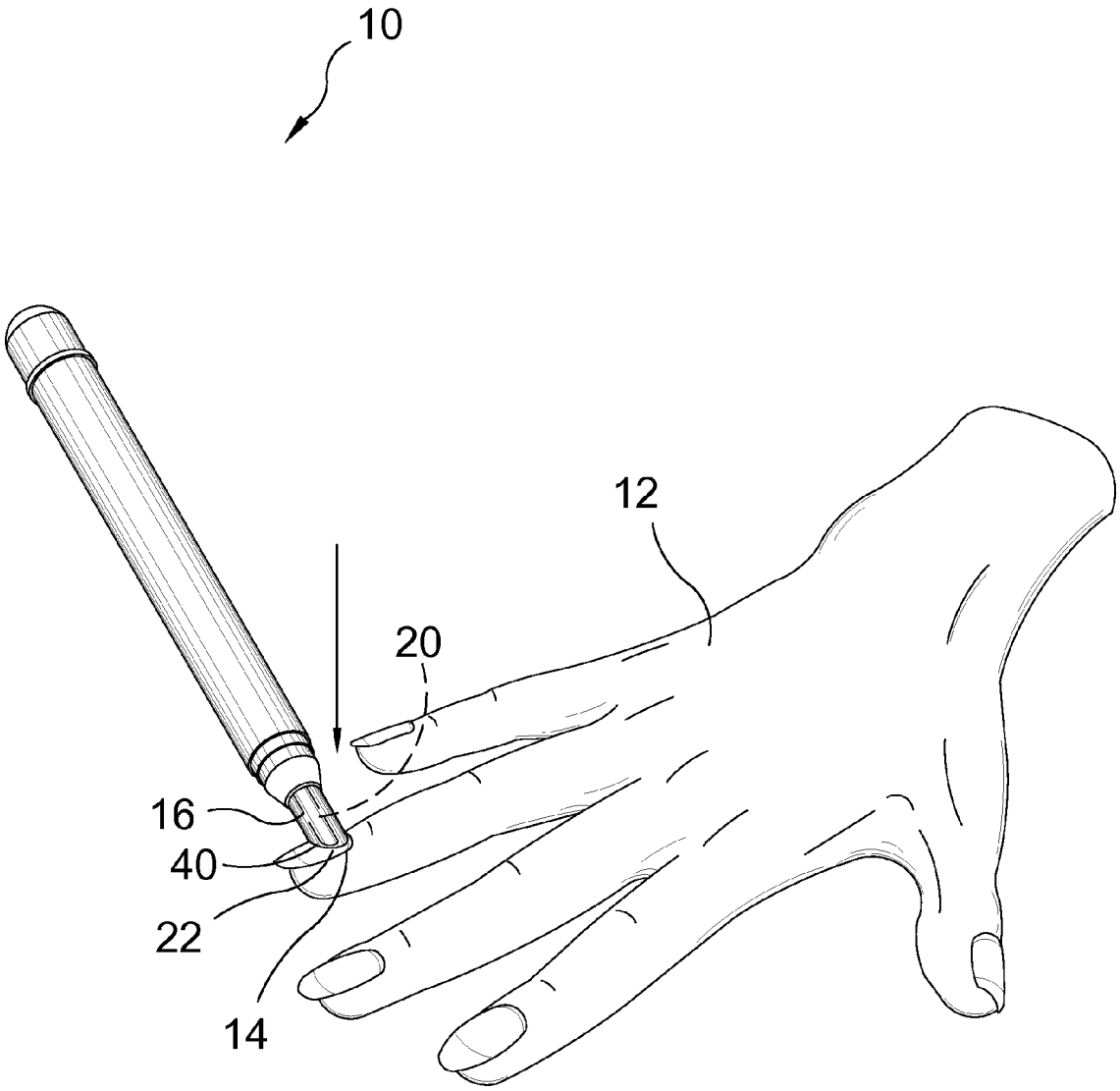
FIG. 7 is an illustrative view of the present invention in use.

FIG. 7 is an illustrative view of the cuticle oil dispenser pen 10 of the present invention in use. Shown is the user 12 applying cuticle oil 22 to the cuticle 14 during treatment with the porous ceramic cuticle stone 16.

Figure 8:
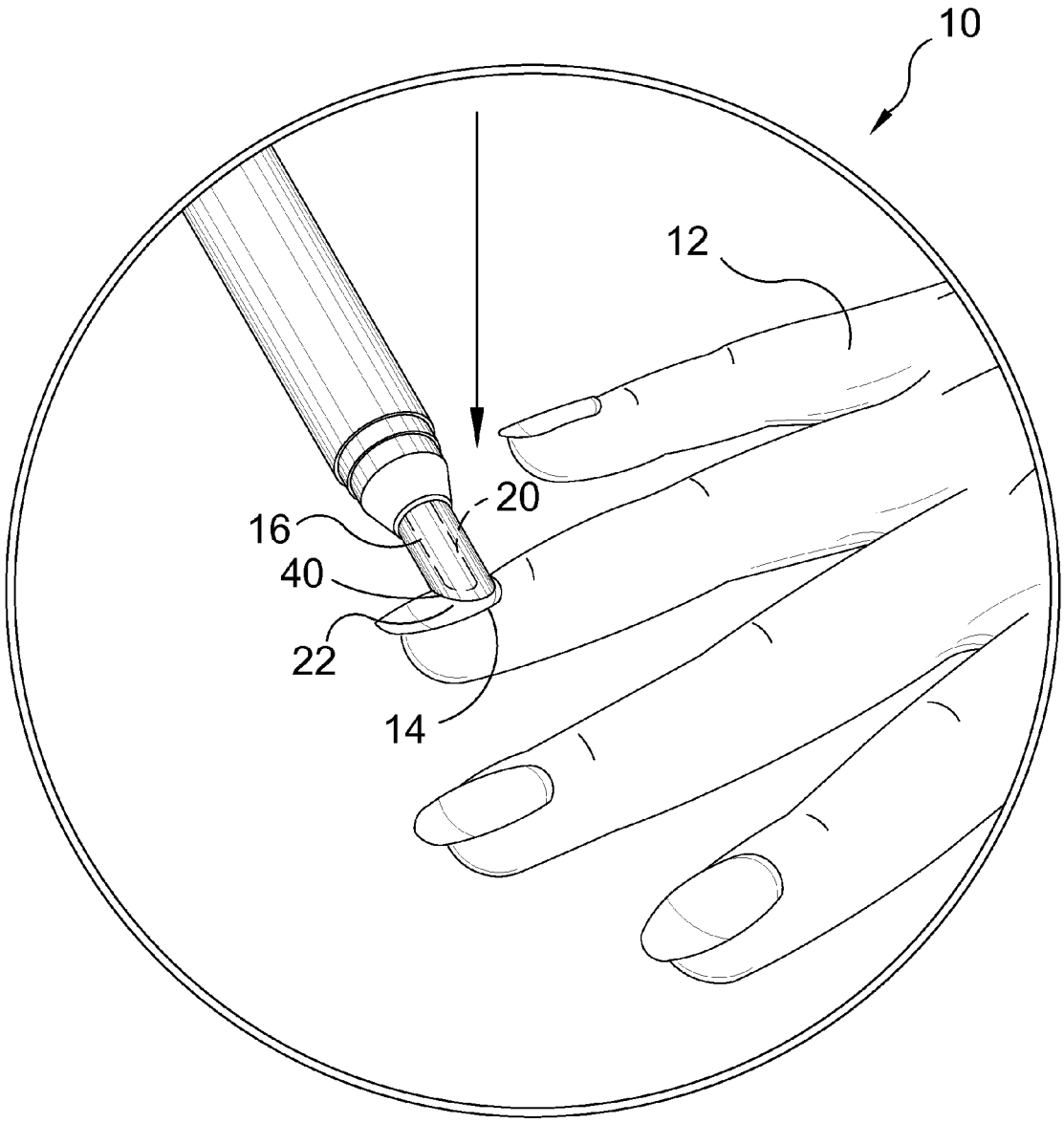
FIG. 8 is a detailed illustrative view of the present invention in use.

FIG. 8 is a detailed illustrative view of the cuticle oil dispenser pen 10 of the present invention in use. Shown is the user 12 applying cuticle oil 22 to the cuticle 14 during treatment with the porous ceramic cuticle stone 16.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination cuticle oil dispensing pen and porous ceramic cuticle stone for moisturizing, cutting and smoothing cuticles comprising:

a) an elongate cylindrical body portion having a first end and a second end;

b) a reservoir disposed within said body portion;

c) a quantity of cuticle oil contained within said reservoir;

d) a porous ceramic cuticle stone projecting from said first end of said body portion;

e) means for delivering said cuticle oil from said reservoir into the distal surface of said porous ceramic cuticle stone; and f) wherein said oil delivery means is a conduit communicating between said reservoir and approximate said distal surface of said porous ceramic cuticle stone.

2. The combination cuticle oil dispensing pen and porous ceramic cuticle stone according to claim 1, wherein said cavity extends through a central channel disposed in said ceramic cuticle stone.

3. The combination cuticle oil dispensing pen and ceramic cuticle stone according to claim 2, further comprising a filter disposed within said first end of said body portion prior to the entry point of said conduit to prevent said conduit from clogging due to any contaminants that may have been introduced to said cuticle oil.

4. The combination cuticle oil dispensing pen and porous ceramic cuticle stone according to claim 1, including a gasket member disposed between said first end of said body portion and said porous ceramic cuticle stone to prevent leakage of said cuticle oil therethrough.

5. The combination cuticle oil dispensing pen and porous ceramic cuticle stone according to claim 2, wherein said cuticle oil is delivered to said distal surface of said ceramic cuticle stone during the cutting and smoothing of the cuticle.

6. The combination cuticle oil dispensing pen and ceramic cuticle stone according to claim 5, wherein said distal surface of said ceramic cuticle stone has an angular configuration.

7. The combination cuticle oil dispensing pen and ceramic cuticle stone according to claim 1, wherein said reservoir is refillable.

8. The combination cuticle oil dispensing pen and ceramic cuticle stone according to claim 7, wherein said second end of said body portion has a removable refill plug for refilling said reservoir with said cuticle oil.

9. The combination cuticle oil dispensing pen and ceramic cuticle stone according to claim 1, further comprising a snap-on cap for protecting said ceramic cuticle stone and containing any leakage therefrom.

10. A combination cuticle oil dispensing pen and ceramic cuticle stone comprising:

a) an elongate, substantially cylindrical body portion having a first end and a second end;

b) a reservoir disposed within said body portion;

c) a quantity of cuticle oil disposed within said reservoir;

d) a conduit projecting from said reservoir and extending beyond said first end of said body portion;

e) a substantially cylindrical porous ceramic cuticle stone with an angular distal surface disposed at said first end of said body portion;

f) a centrally disposed cavity extending through said porous ceramic cuticle stone through which said conduit passes to deliver said cuticle oil to said distal surface thereof;

g) a filter disposed in said reservoir prior to the oil entry point of said conduit;

h) a gasket disposed at said first end of said body portion between said ceramic cuticle stone to prevent leakage of oil therethrough; and i) a removable refill plug disposed within said second end of said body portion.

* * * * *